US011560813B2

(12) United States Patent
Burke

(10) Patent No.: US 11,560,813 B2
(45) Date of Patent: Jan. 24, 2023

(54) RECIRCULATING HYDRAULIC FLUID CONTROL VALVE

(71) Applicant: Schaeffler Technologies AG & Co. KG, Herzogenaurach (DE)

(72) Inventor: Steven Burke, Fort Gratiot, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 53 days.

(21) Appl. No.: 17/205,434

(22) Filed: Mar. 18, 2021

(65) Prior Publication Data

US 2022/0298933 A1 Sep. 22, 2022

(51) Int. Cl.
*F01L 1/344* (2006.01)
*F01L 13/00* (2006.01)

(52) U.S. Cl.
CPC ..... *F01L 1/3442* (2013.01); *F01L 2001/3443* (2013.01); *F01L 2001/34423* (2013.01); *F01L 2001/34426* (2013.01); *F01L 2001/34433* (2013.01); *F01L 2001/34479* (2013.01); *F01L 2013/101* (2013.01); *F01L 2820/031* (2013.01)

(58) Field of Classification Search
CPC ..... F01L 1/3442; F01L 2001/34423; F01L 2001/34426; F01L 2001/3443; F01L 2013/101; F01L 2820/031
USPC ..... 123/90.17
See application file for complete search history.

(56) References Cited

U.S. PATENT DOCUMENTS

| | | | | |
|---|---|---|---|---|
| 10,914,204 | B2 | 2/2021 | Mitsutani | |
| 2015/0300213 | A1 | 10/2015 | Kaufmann et al. | |
| 2017/0058726 | A1 | 3/2017 | Smith et al. | |
| 2018/0016950 | A1 | 1/2018 | Haltiner, Jr. | |
| 2018/0171835 | A1* | 6/2018 | Sakaguchi | F16K 51/00 |
| 2018/0363514 | A1 | 12/2018 | Stanhope | |
| 2019/0107014 | A1 | 4/2019 | Smith | |
| 2019/0234244 | A1 | 8/2019 | Hisaeda et al. | |
| 2020/0047814 | A1* | 2/2020 | Ozeki | F01L 1/267 |
| 2020/0049031 | A1* | 2/2020 | Nishimoto | F02D 13/06 |
| 2020/0248822 | A1 | 8/2020 | Stanhope | |
| 2020/0269379 | A1 | 8/2020 | Bruce et al. | |
| 2020/0370450 | A1 | 11/2020 | Huerta Ortiz et al. | |
| 2021/0381403 | A1* | 12/2021 | Mitsutani | F01L 1/34409 |

FOREIGN PATENT DOCUMENTS

| | | | | | |
|---|---|---|---|---|---|
| CN | 110318836 | A | | 10/2019 | |
| CN | 110359976 | A | | 10/2019 | |
| CN | 110360347 | A | | 10/2019 | |
| CN | 110966062 | A | * | 4/2020 | F01L 1/3442 |
| DE | 102016118962 | A1 | | 4/2018 | |
| JP | 2009264153 | A | | 11/2009 | |
| JP | 2020024018 | A | | 2/2020 | |
| KR | 20170026238 | A | * | 3/2017 | F01L 1/34 |

* cited by examiner

*Primary Examiner* — Jorge L Leon, Jr.

(57) ABSTRACT

A hydraulic fluid control valve (HFCV) configured to recirculate an exiting hydraulic fluid from a first hydraulic actuation chamber to a second hydraulic actuation chamber is provided. The HFCV includes a selectively movable spool having an outer annulus configured to receive and deliver the exiting hydraulic fluid to one or both of either a sump or one of the first or second hydraulic actuation chambers.

20 Claims, 7 Drawing Sheets

RECIRCULATING HYDRAULIC FLUID CONTROL VALVE

TECHNICAL FIELD

This disclosure is generally related to a hydraulic fluid control valve that can be applied to a hydraulically actuated component or system, including, but not limited to, a camshaft phaser for an internal combustion (IC) engine.

BACKGROUND

A hydraulic fluid control valve can manage delivery of pressurized hydraulic fluid to a hydraulically actuated component such as a camshaft phaser of an internal combustion engine. Pressurized hydraulic fluid in an internal combustion engine is provided by a hydraulic fluid pump that is fluidly connected to a reservoir or sump of hydraulic fluid. The size, and, thus, power requirement of the hydraulic fluid pump is dependent upon a total volume of pressurized fluid that is requested or consumed by the internal combustion engine and its associated hydraulic fluid systems. This requested or consumed hydraulic fluid can be reduced by recirculating and re-using at least some of the hydraulic fluid that is typically returned to the reservoir or sump after being utilized for actuation purposes within a hydraulically actuated component.

SUMMARY

An example embodiment of a hydraulic fluid control valve is provided that includes a housing and a spool. The housing has a first fluid port configured to be fluidly connected to a first hydraulic actuation chamber and a second fluid port configured to be fluidly connected to a second hydraulic actuation chamber. The first and second hydraulic actuation chambers are configured to receive and exit hydraulic fluid. The spool is disposed within a bore of the housing. The spool has a a first aperture, a second aperture, a third aperture, an outer annulus, and an inner fluid chamber. The first aperture can be arranged at an actuation end of the spool, and the third aperture is arranged at a spring end of the spool. The first aperture can be configured to receive hydraulic fluid from a pressurized hydraulic fluid source. The inner fluid chamber is configured to flow hydraulic fluid from the first aperture to the second aperture, and from the first aperture to the third aperture. The inner chamber is configured to continuously fluidly connect any one of the three apertures to each other in the first and second axial positions of the spool. In a longitudinal direction of the spool, the second aperture is arranged between the first and third apertures, the outer annulus is arranged between the second and third apertures, and the inner fluid chamber extends from the first aperture to the third aperture.

In a first axial position of the spool, the first aperture is configured to deliver hydraulic fluid to the first hydraulic actuation chamber. In the first axial position, the outer annulus is configured to receive hydraulic fluid from the second hydraulic actuation chamber and deliver at least a portion of the hydraulic fluid from the second hydraulic actuation chamber to the first hydraulic actuation chamber. In the first axial position, the outer annulus is configured to deliver a remaining portion of the hydraulic fluid from the second hydraulic actuation chamber to a vent arranged within the hydraulic fluid control valve.

In a second axial position of the spool, the third aperture is configured to deliver hydraulic fluid to the second hydraulic actuation chamber. In the second axial position the outer annulus is configured to receive hydraulic fluid from the first hydraulic actuation chamber and deliver at least a portion of the hydraulic fluid from the first hydraulic actuation chamber to the second hydraulic actuation chamber. In the second axial position of the spool, the outer annulus is configured to deliver a remaining portion of the hydraulic fluid from the first hydraulic actuation chamber to a vent arranged within the hydraulic fluid control valve. The vent can be fluidly connected to an axial end of the hydraulic fluid control valve.

In an example embodiment, the hydraulic fluid control valve includes a one-way valve arranged between the spool and an inner surface of the bore of the housing. The one-way valve can be configured to: i) allow hydraulic fluid to flow from the outer annulus to the first and second hydraulic actuation chambers, and ii) prevent hydraulic to flow from the first and second hydraulic actuation chambers to the outer annulus. The one-way valve can open in a radially outward direction to allow hydraulic fluid to flow from the outer annulus to the first and second hydraulic actuation chambers.

In an example embodiment, the hydraulic fluid control valve control valve includes a stationary hydraulic sleeve arranged radially between the spool and the housing, and the one-way valve is arranged on the stationary hydraulic sleeve. The stationary hydraulic sleeve can include: at least one first fluid opening that is continuously fluidly connected to the first aperture; at least one second fluid opening that is configured to be selectively fluidly connected to one of either the second aperture or the outer anulus; at least one third fluid opening configured to be selectively fluidly connected to one of either the third aperture or the outer annulus; and, at least one fourth fluid opening configured to be continuously fluidly connected to the outer annulus. The at least one fourth fluid opening can be configured to be fluidly connected to both the first and second hydraulic actuation chambers.

In an example embodiment, the housing includes a third fluid port configured to fluidly connect the spool to a pressurized hydraulic fluid source.

In an example embodiment, the housing includes a fourth fluid port configured as a vent port, and the fourth fluid port is arranged between the third fluid port and a solenoid of the hydraulic fluid control valve in a longitudinal direction of the hydraulic fluid control valve.

In an example embodiment, in a first pressure state of the first hydraulic actuation chamber, the outer annulus is configured to: i) receive a first amount of hydraulic fluid from the second hydraulic actuation chamber, and ii) deliver a first fraction of the first amount to the first hydraulic actuation chamber; and, in a second pressure state of the first hydraulic actuation chamber, different than the first pressure state, the outer annulus is configured to: i) receive the first amount of hydraulic fluid from the second hydraulic actuation chamber, and ii) deliver a second fraction of the first amount to the first hydraulic actuation chamber, the second fraction greater than the first fraction.

In an example embodiment, in the first pressure state of the first hydraulic actuation chamber, the outer annulus delivers a third fraction of the first amount to a vent of the hydraulic fluid control valve; and, in the second pressure state of the first hydraulic actuation chamber, the outer annulus delivers a fourth fraction of the first amount to the vent of the hydraulic fluid control valve, the fourth fraction less than the third fraction.

An example embodiment of a hydraulic fluid control valve configured to be attached as a single unit to an internal combustion engine is provided with a coil, an armature, a push pin attached to the armature, a housing, and a spool actuated by the push pin. The armature is surrounded by the coil and configured to be actuated by a magnetic field generated by the coil. The spool includes a first outer land, a second outer land, and an outer annulus formed by the first and second outer lands. The outer annulus is configured to: i) recirculate hydraulic fluid from either one of the first or second hydraulic actuation chambers to a remaining one of the first or second hydraulic actuation chambers; and, ii) route hydraulic fluid to a vent passage of the hydraulic fluid control valve. The spool includes an inner fluid chamber having a radial outer wall that includes a first aperture, a second aperture, and a third aperture. The inner fluid chamber is configured to continuously fluidly connect the first, second, and third apertures to each other. The first and second outer lands, the radial outer wall, and the first, second, and third apertures are all formed integrally with the spool.

In an example embodiment, the vent passage extends axially toward a spring end of the spool and exits through an axial open end of the hydraulic fluid control valve.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
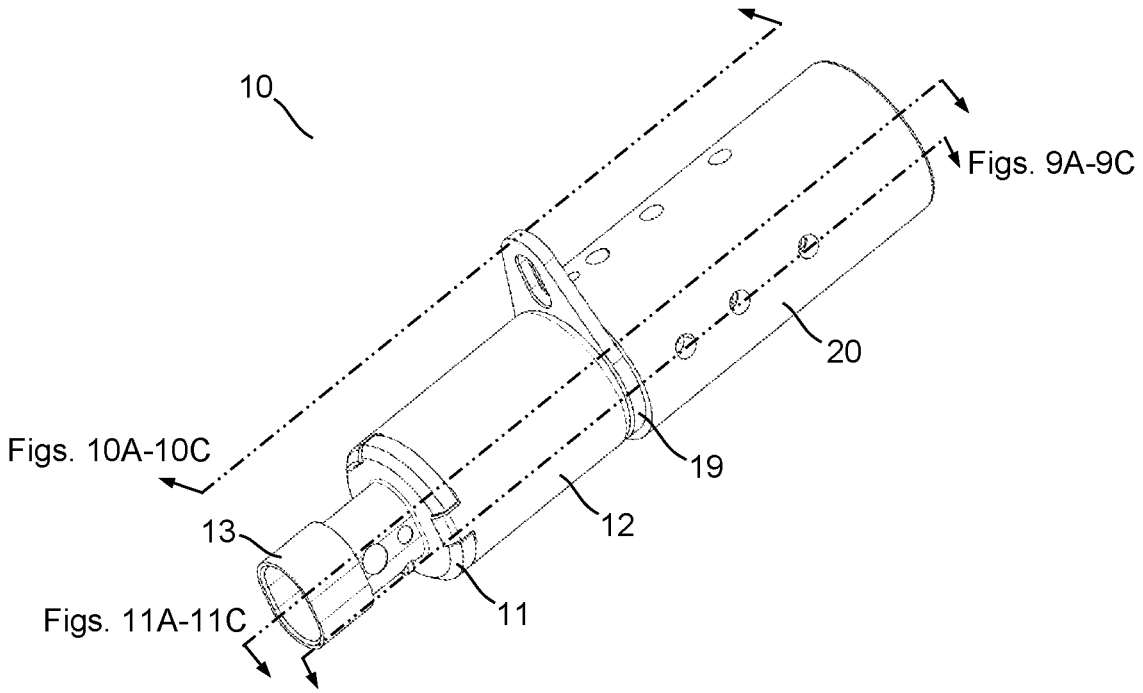
FIG. 1 is a perspective view of an example embodiment of a hydraulic fluid control valve (HFCV).

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis or a rotational axis. Radially refers to directions that are perpendicular to the central axis. The words "left", "right", "up", "upward", "upper", "down", "downward", and "lower" designate directions in the drawings to which reference is made. The terminology includes the words specifically noted above, derivatives thereof, and words of similar import.

Figure 2:
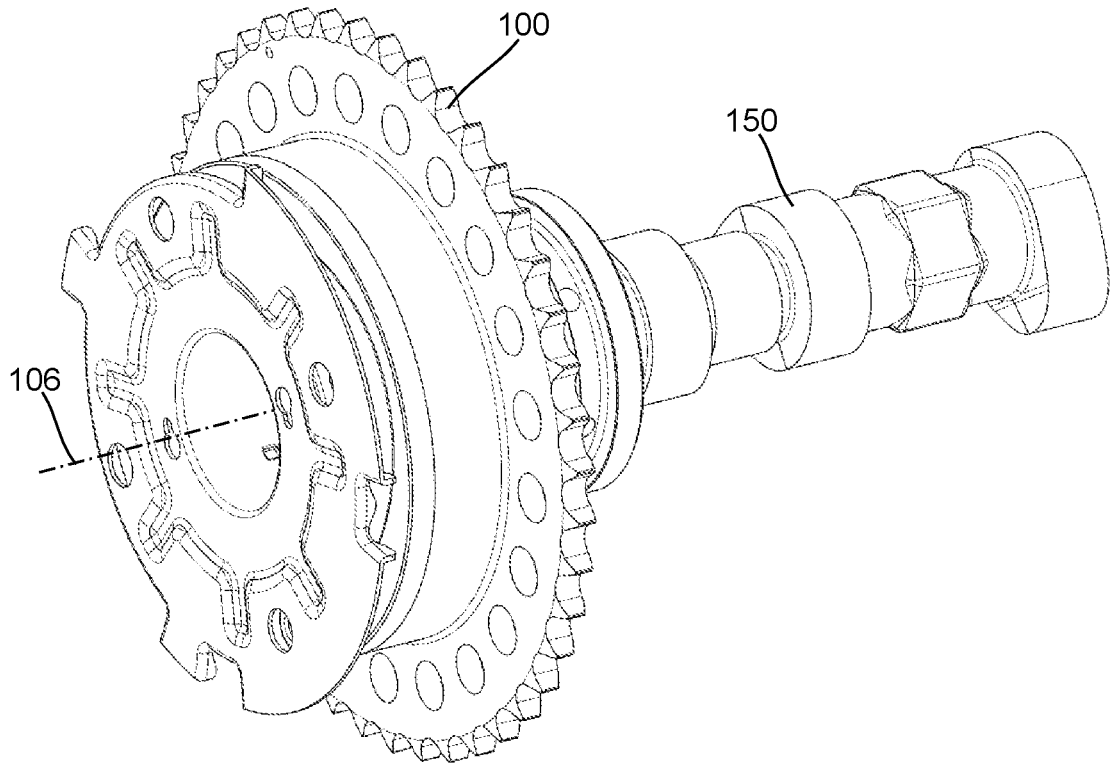
FIG. 2 is a perspective view of a camshaft phaser connected to a camshaft that can be utilized together with the HFCV of FIG. 1.
Figure 3:
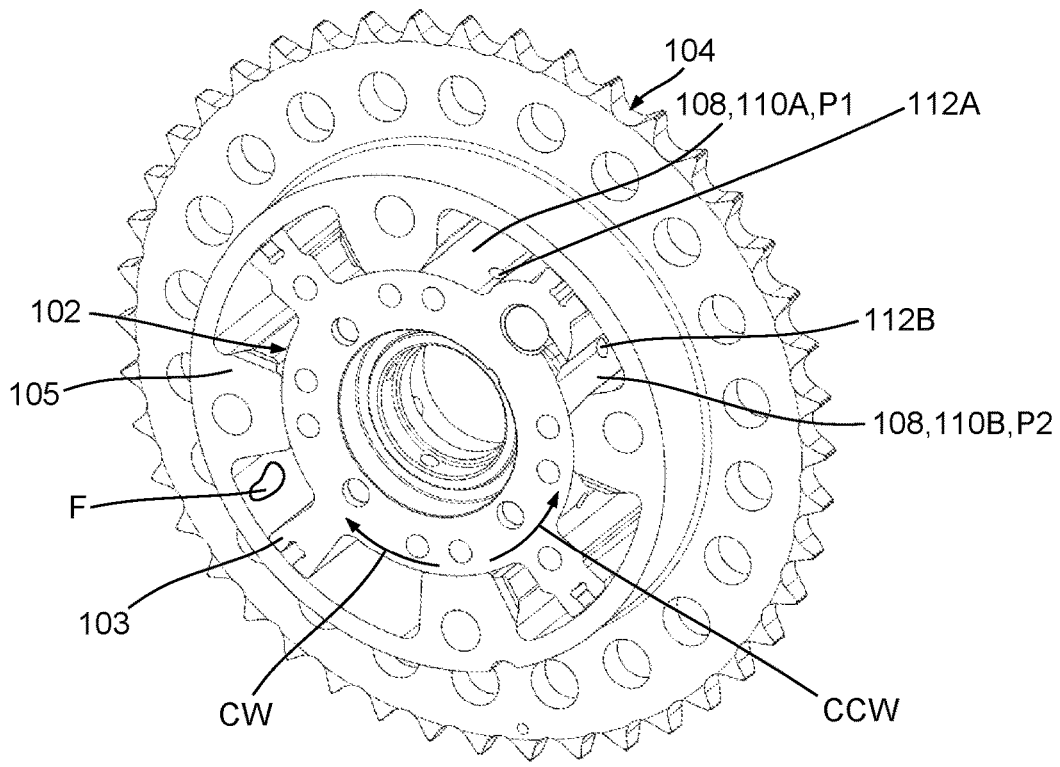
FIG. 3 is a perspective view of a rotor and a stator of the camshaft phaser of FIG. 1.
Figure 4:
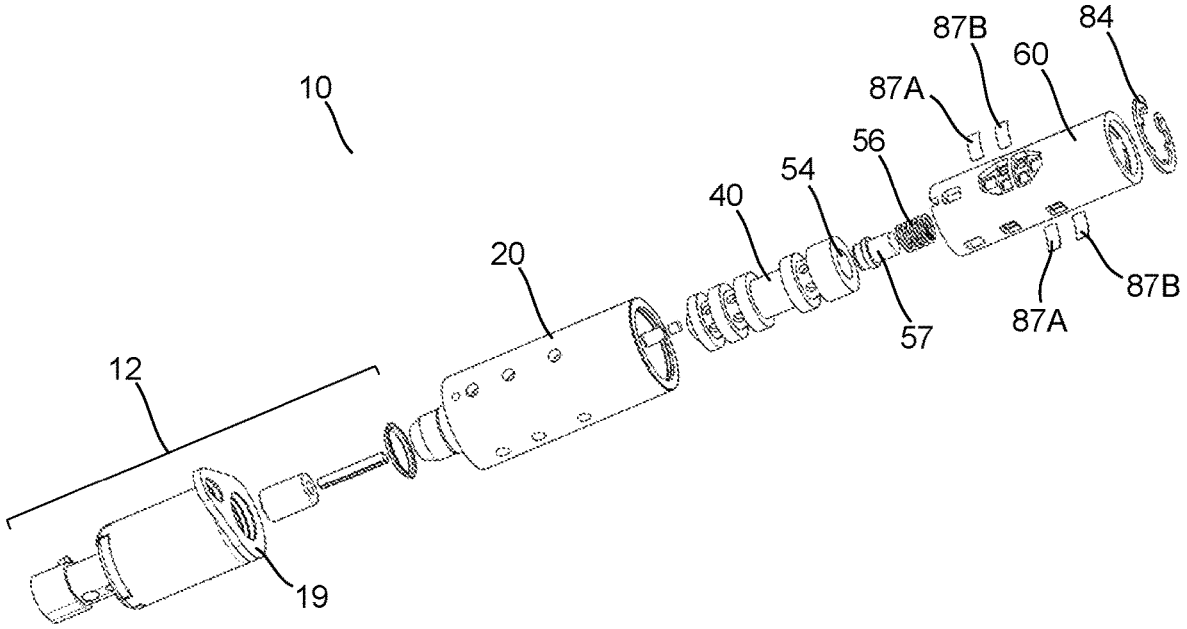
FIG. 4 is an exploded perspective view of the HFCV of FIG. 1 including a solenoid, a valve housing, a spool, and a hydraulic sleeve with one-way valves.
Figure 5:
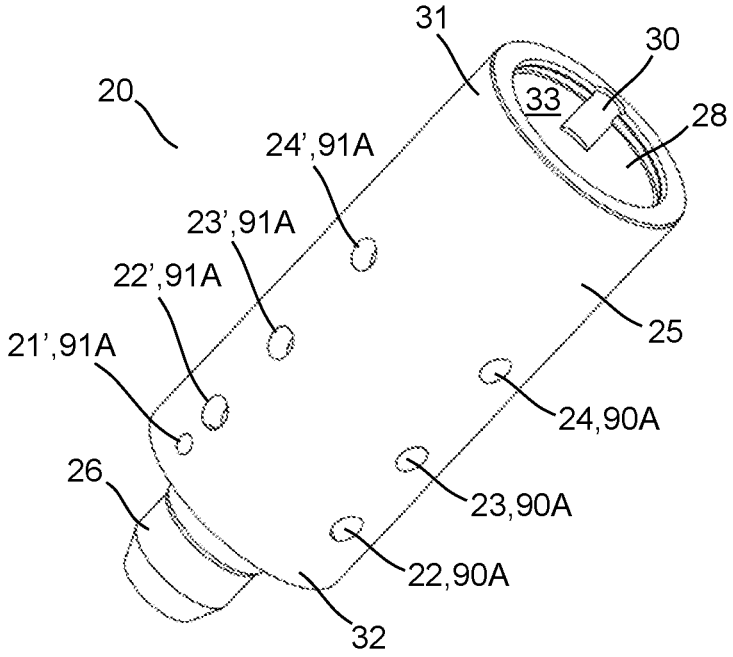
FIG. 5 is a perspective view of the valve housing of FIG. 4.
Figure 6:
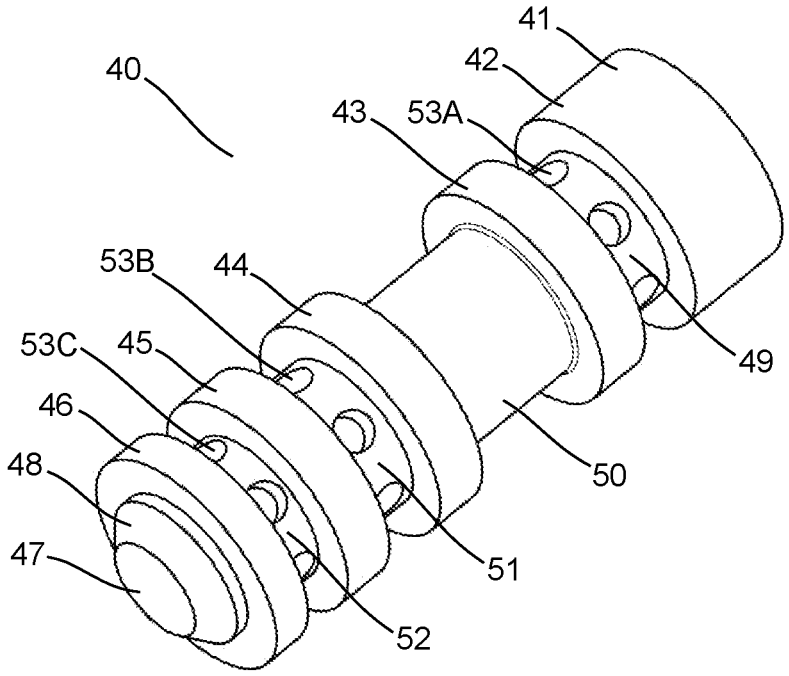
FIG. 6 is a perspective view of the spool of FIG. 4.
Figure 7A:
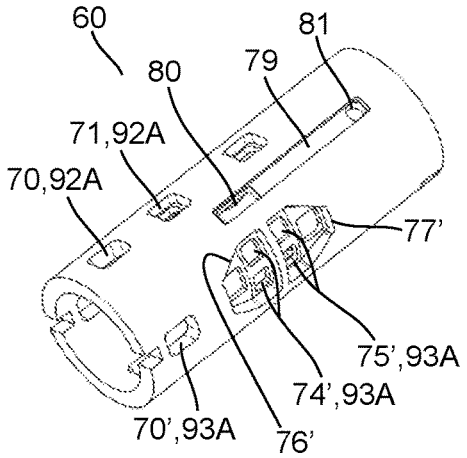
FIG. 7A is a perspective view of the hydraulic sleeve of FIG. 4 without the one-way valves installed.
Figure 7B:
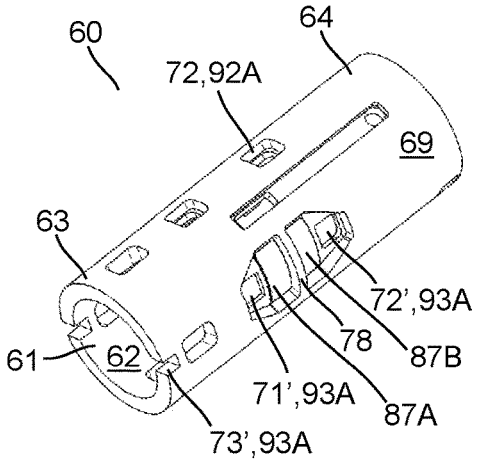
FIG. 7B is a perspective view of the hydraulic sleeve of FIG. 4 with the one-way valves installed.
Figure 8:
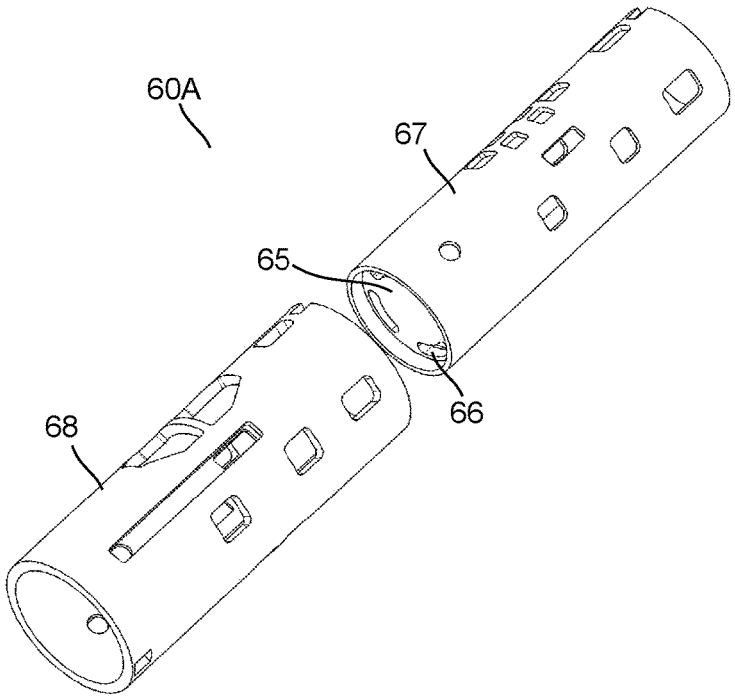
FIG. 8 is a perspective view of an example embodiment of a two-part hydraulic sleeve constructed from an insert molding process or an overmolding process.
Figure 9A:
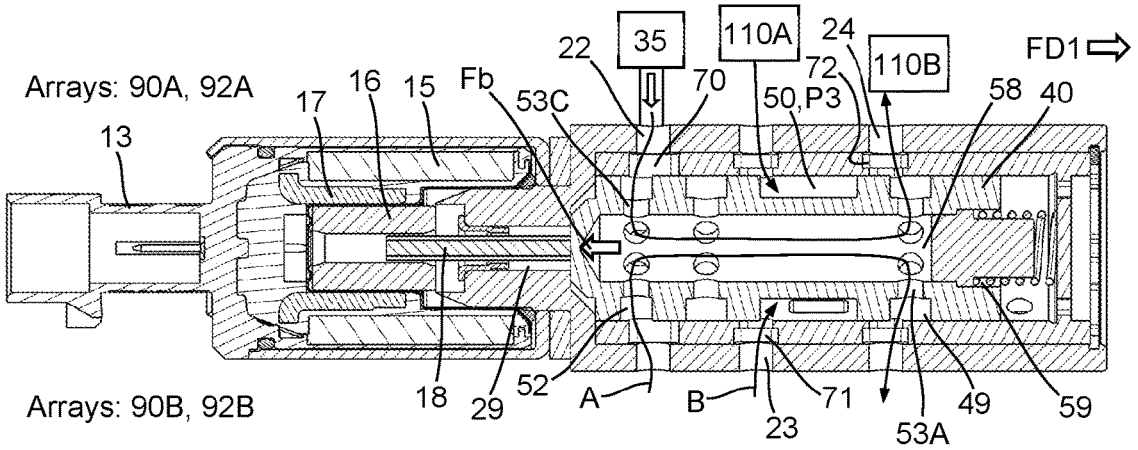
FIG. 9A is a cross-sectional view taken from FIG. 1 when the HFCV is in a de-energized state and the spool is in an extended position.
Figure 9B:
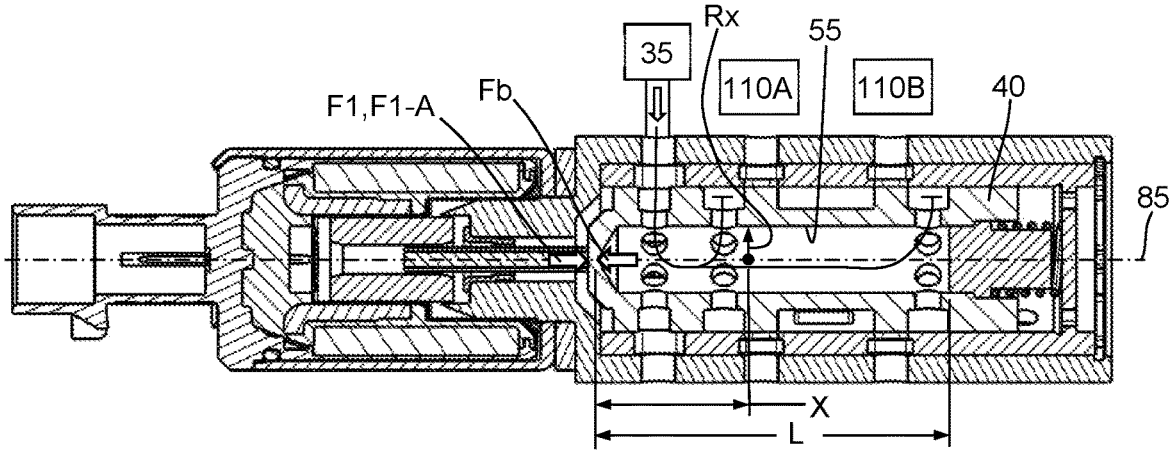
FIG. 9B is a cross-sectional view taken from FIG. 1 when the HFCV is in a first energized state and the spool is in a middle position.
Figure 9C:
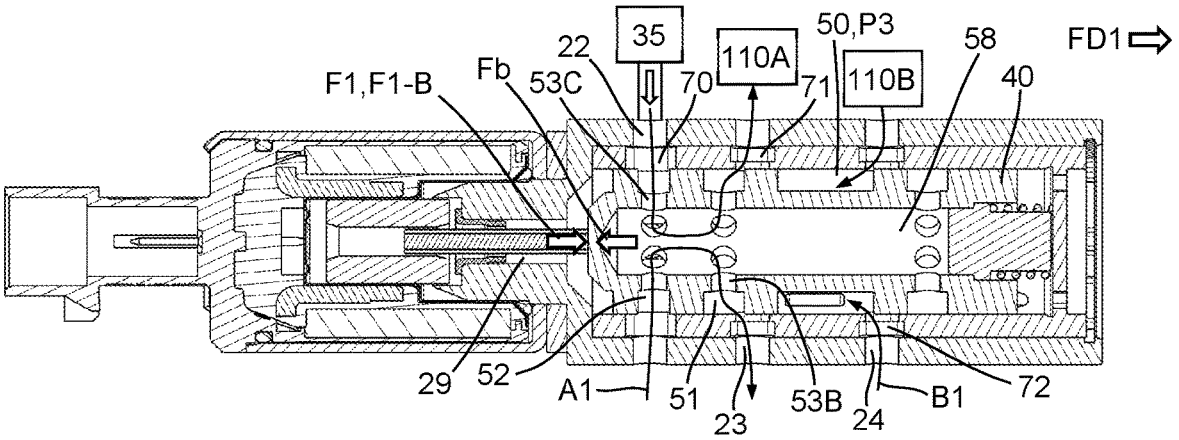
FIG. 9C is a cross-sectional view taken from FIG. 1 when the HFCV is in a second energized state and the spool is in a fully displaced position.
Figure 10A:
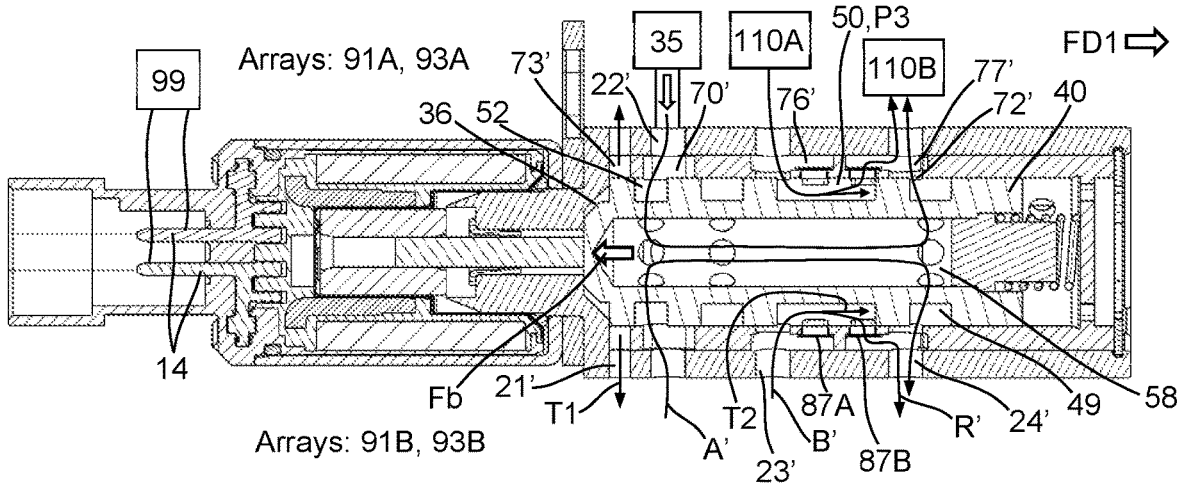
FIG. 10A is a cross-sectional view taken from FIG. 1 when the HFCV is in the de-energized state and the spool is in the extended position.
Figure 10B:
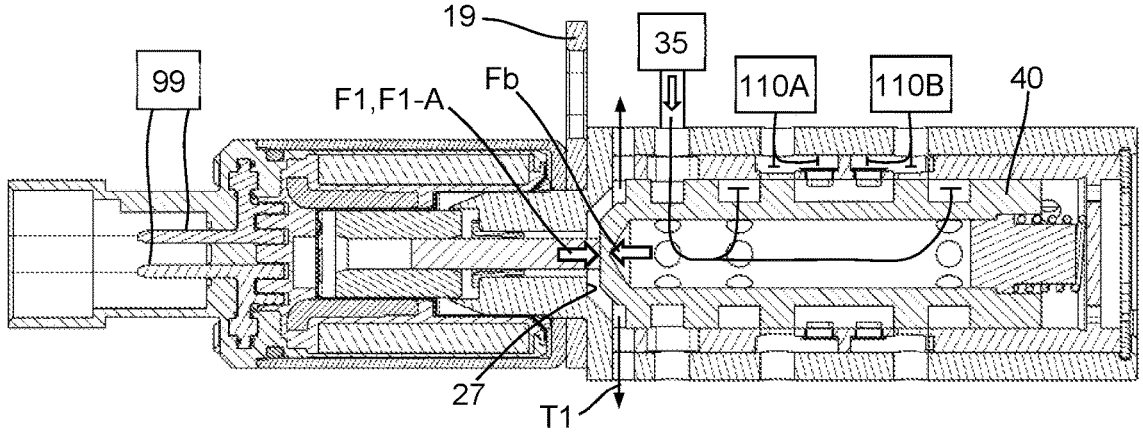
FIG. 10B is a cross-sectional view taken from FIG. 1 when the HFCV is in the first energized state and the spool is in the middle position.
Figure 10C:
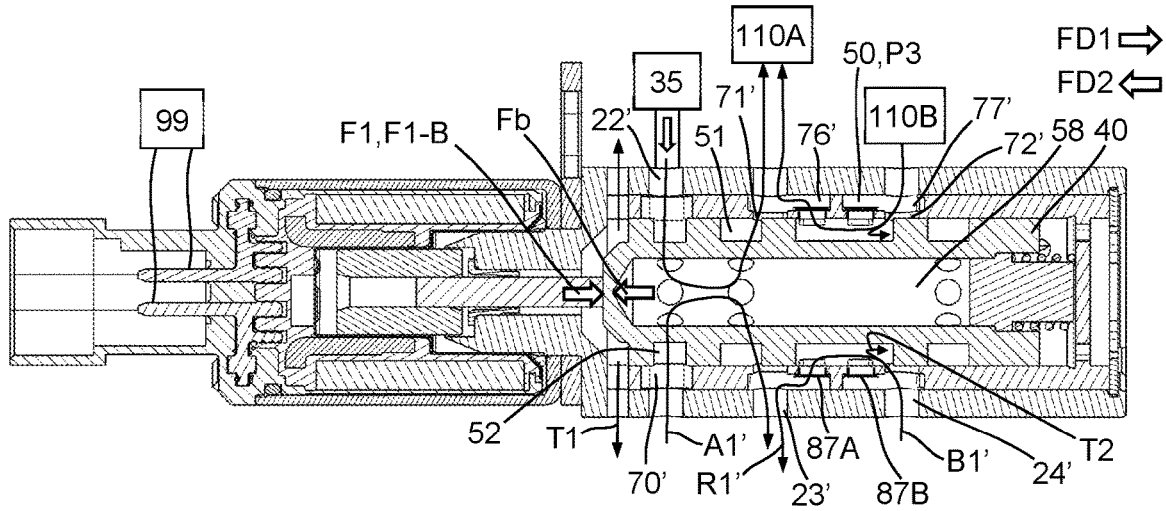
FIG. 10C is a cross-sectional view taken from FIG. 1 when the HFCV is in the second energized state and the spool is in the fully displaced position.
Figure 11A:
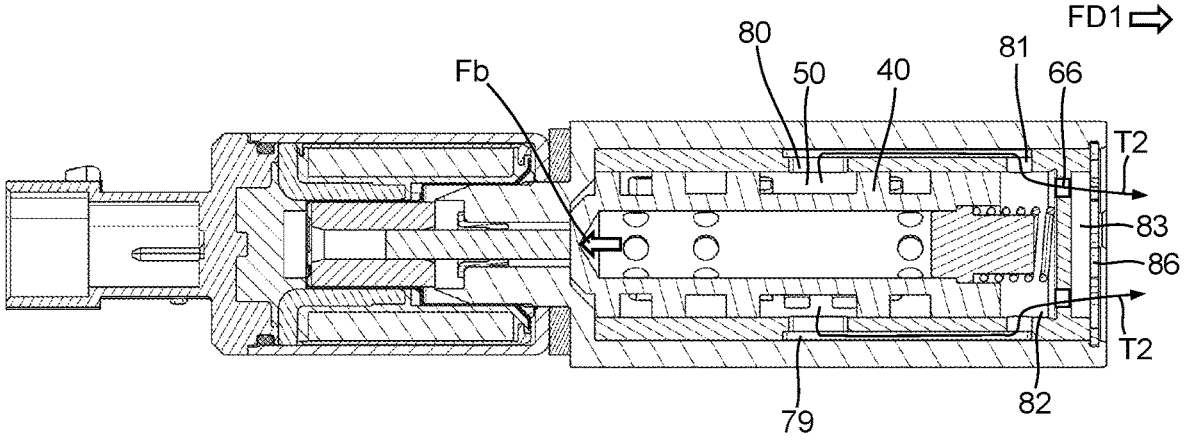
FIG. 11A is a cross-sectional view taken from FIG. 1 when the HFCV is in the de-energized state and the spool is in the extended position.
Figure 11B:
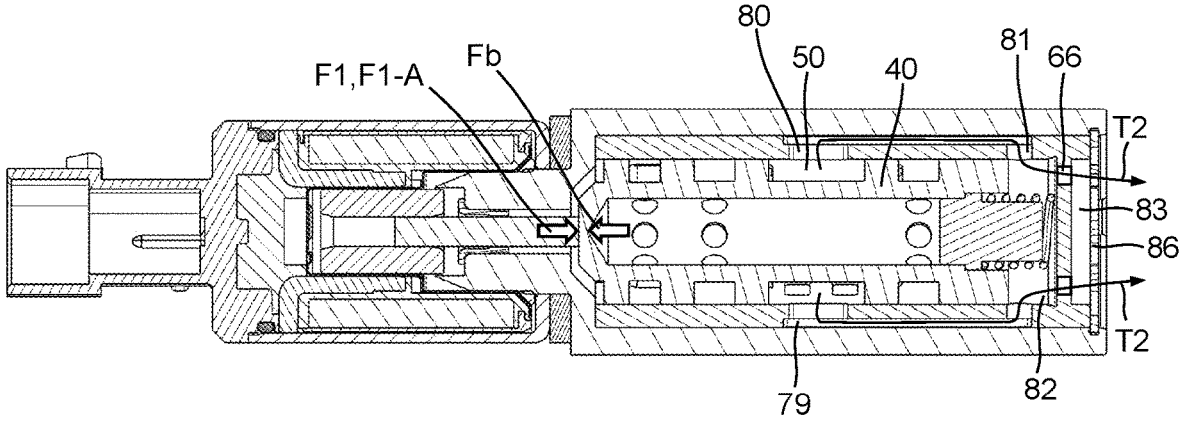
FIG. 11B is a cross-sectional view taken from FIG. 1 when the HFCV is in the first energized state and the spool is in the middle position.
Figure 11C:
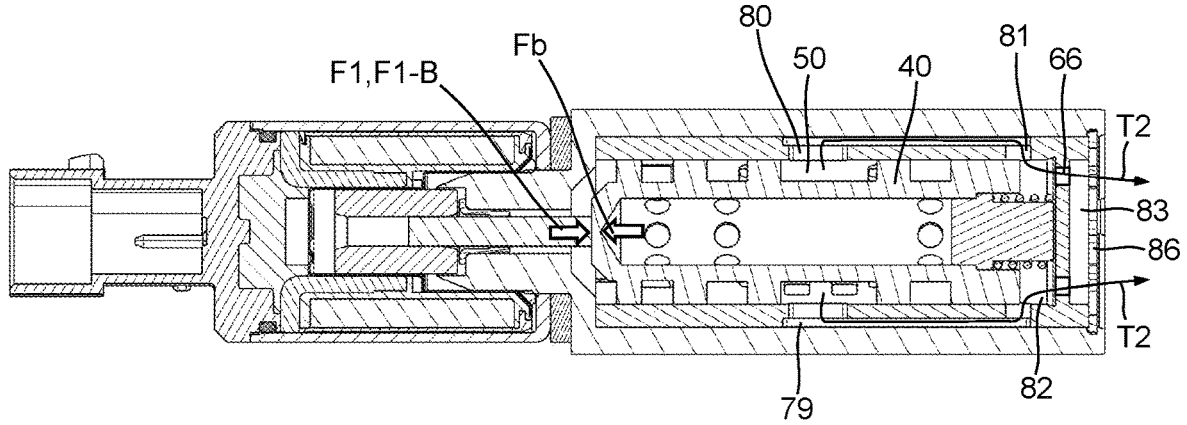
FIG. 11C is a cross-sectional view taken from FIG. 1 when the HFCV is in the second energized state and the spool is in the fully displaced position.

FIG. 1 is a perspective view of an example embodiment of a hydraulic fluid control valve 10 (HFCV). FIG. 2 is a perspective view of a camshaft phaser 100 attached to a camshaft 150 such that the camshaft phaser 100 is controlled by the HFCV 10 of FIG. 1 to phase the camshaft 150 relative to a crankshaft (not shown) of an internal combustion (IC) engine. FIG. 3 is a perspective view of a rotor 102 and a stator 104 of the camshaft phaser 100. FIG. 4 is an exploded perspective view of the HFCV 10 of FIG. 1 including a solenoid assembly 12, a valve housing 20, a spool 40, and a hydraulic sleeve 60 with first and second one-way valves 87A, 87B. FIG. 5 is a perspective view of the valve housing 20 of FIG. 4. FIG. 6 is a perspective view of the spool 40 of FIG. 4. FIG. 7A is a perspective view of the hydraulic sleeve 60 of FIG. 4 without the first and second one-way valves 87A, 87B installed. FIG. 7B is a perspective view of the hydraulic sleeve 60 of FIG. 4 with the first and second one-way valves 87A, 87B installed. FIG. 8 is a perspective view of an example embodiment of a two-part hydraulic sleeve constructed from an insert molding process or an overmolding process. FIG. 9A is a cross-sectional view taken from FIG. 1 when the HFCV 10 is in a de-energized state and the spool 40 is in an extended position. FIG. 9B is a cross-sectional view taken from FIG. 1 when the HFCV 10 is in a first energized state and the spool 40 is in a middle position. FIG. 9C is a cross-sectional view taken from FIG. 1 when the HFCV 10 is in a second energized state and the spool 40 is in a fully displaced position. FIG. 10A is a cross-sectional view taken from FIG. 1 when the HFCV 10 is in the de-energized state and the spool 40 is in the extended position. FIG. 10B is a cross-sectional view taken from FIG. 1 when the HFCV 10 is in the first energized state and the spool 40 is in the middle position. FIG. 10C is a cross-sectional view taken from FIG. 1 when the HFCV 10 is in the second energized state and the spool 40 is in the fully displaced position. FIG. 11A is a cross-sectional view taken from FIG. 1 when the HFCV 10 is in the de-energized state and the spool 40 is in the extended position. FIG. 11B is a cross-sectional view taken from FIG. 1 when the HFCV 10 is in the first energized state and the spool 40 is in the middle position. FIG. 11C is a cross-sectional view taken from FIG. 1 when the HFCV 10 is in the second energized state and the spool 40 is in the fully displaced position. The following discussion should be read in light of FIGS. 1 through 11C.

The camshaft phaser 100 is hydraulically actuated by pressurized hydraulic fluid F that is controlled by the HFCV 10 to rotate the rotor 102 either clockwise CW or counterclockwise CCW about a rotational axis 106 relative to the stator 104 via hydraulic actuation chambers 108. The hydraulic actuation chambers 108 are formed via outwardly protruding vanes 103 of the rotor 102 and inwardly protruding lugs 105 of the stator 104. As the rotor 102 is connected to the camshaft 150, clockwise CW and counterclockwise CCW rotation of the rotor 102 relative to the stator 104 can advance or retard an engine valve event with respect to a four-stroke cycle of an IC engine. Clockwise CW rotation of the rotor 102 relative to the stator 104 can be achieved by: 1). pressurization of first hydraulic actuation chambers 110A via a first hydraulic fluid gallery 112A arranged in the rotor 102; and, 2). de-pressurization of second hydraulic actuation chambers 110B via a second hydraulic fluid gallery 112B arranged in the rotor 102 that fluidly connects the second hydraulic actuation chambers 110B to a vent passage via the HFCV 10 that returns the hydraulic fluid to "tank" or a sump. Likewise, counterclockwise CCW rotation of the rotor 102 relative to the stator 104 can be achieved by: 1). pressurization of the second hydraulic actuation chambers 110B via the second hydraulic fluid gallery 112B arranged in the rotor 102; and, 2). de-pressurization of the first hydraulic actuation chambers 110A via the first hydraulic fluid gallery 112A that fluidly connects the first hydraulic actuation chambers 110A to tank via the HFCV 10. The preceding pressurization and de-pressurization actions of the first and second hydraulic actuation chambers 110A, 110B can be accomplished by the HFCV 10. The HFCV 10 is fluidly connected to a hydraulic fluid pressure source 35 such as an oil pump and can communicate electronically via terminals 14 with a controller 99 such as an engine control unit (ECU) to control the camshaft phaser 100. Although the HFCV 10 is described as controlling the camshaft phaser 100, any phase adjustment mechanism such as, but not limited to, that utilized for a variable compression ratio system could be controlled by the HFCV 10.

The HFCV 10 includes the solenoid assembly 12, the valve housing 20, the spool 40, a bias spring 56, the hydraulic sleeve 60, and a retaining ring 84.

The solenoid assembly 12 includes an electrical connector 13, a coil 15, an armature 16, a first pole 17, a push pin 18, and a mounting plate 19. The electrical connector 13 includes two terminals 14 configured to facilitate electronic communication with the ECU 99. The mounting plate 19 is shown together with the solenoid assembly 12 in FIG. 4, however, it could also be part of another sub-assembly of the HFCV 10 or merely a stand-alone component. The push pin 18 is rigidly mounted to the armature 16 so that the push pin 18 moves in unison with the armature 16. The HFCV 10 can be described as a pulse-width modulated proportional valve that is commonly used for camshaft phaser applications.

The valve housing 20 includes a body 25 and a second pole 26 that extends from an actuator end 32 of the body 25 into a portion of the coil 15. The body 25 has a first array of ports 90A that includes a supply fluid port 22, a first fluid port 23, and a second fluid port 24. The body 25 also has a second array of ports 91A that includes a vent fluid port 21', a supply fluid port 22', a first fluid port 23', and a second fluid port 24'. Each of the first and second array of ports 90A, 91A has a duplicate array of ports 90B, 91B arranged 180 degrees opposite or opposed to the first and second arrays of ports 90A, 91A. FIG. 5 best shows the first and second array of ports 90A, 91A parametrically. The top of the cross-sectional views of FIGS. 9A-9C show the first array of ports 90A and the bottom of the cross-sectional views of 9A-9C show the duplicate first array of ports 90B. Similarly, the top of the cross-sectional views of FIGS. 10A-10C show the second array of ports 91A and the bottom of the cross-sectional views of FIGS. 10A-10C show the duplicate second array of ports 91B. Within the Figures, the element numbers of the duplicate first and second arrays of ports 90B, 91B are identical to the element numbers of the first and second arrays of ports 90A, 91A.

A first bore 28 of the valve housing 20 extends through the body 25 such that it intersects and connects with each radially arranged supply fluid port 22, first fluid port 23, and second fluid port 24. A second bore 29, directly connected to the first bore 28, extends through the second pole 26. The push pin 18 moves longitudinally within the second bore 29 to actuate the spool 40. An anti-rotation cavity 30 is located at a retaining end 31 of the first bore 28 and is configured to receive a protrusion of the hydraulic sleeve 60 to align the hydraulic sleeve 60 relative to the valve housing 20. The hydraulic sleeve 60 is retained within the first bore 28 of the valve housing 20 to one stationary position by the retaining ring 84.

The spool 40 of the HFCV 10 is biased towards the solenoid assembly 12 or an actuator end 11 of the HFCV 10 by a force Fb of the bias spring 56. The pulse-width modulated solenoid assembly 12 can apply a force F1 on a push pin receiving land 47 arranged on an actuator end 48 of the spool 40 to overcome a biasing force Fb of the bias spring 56 to selectively move the spool 40 to a desired longitudinal position such as that shown in FIGS. 9B and 9C. Other forms of actuators or solenoid assemblies to move the spool 40 are also possible. A position of the spool 40 within the HFCV 10 is controlled by the ECU 99 which can control a duty cycle of the solenoid assembly 12.

The HFCV 10 could be arranged within the camshaft phaser 100; for example, the HFCV 10 could be configured as a central fastener that attaches the camshaft phaser 100 to the camshaft 150. The HFCV 10 could also be arranged at a remote location within the IC engine outside of the confines of the camshaft phaser 100. The embodiments and functional strategies described herein can also apply to other HFCV applications not described in this disclosure.

Referring to FIGS. 9A and 9C, with view to FIG. 3, different longitudinal positions of the spool 40 are shown in which pressurized hydraulic fluid is selectively delivered to either the first or second hydraulic actuation chambers 110A, 110B of the camshaft phaser 100 via: i) the first and second fluid galleries 112A, 112B arranged within the rotor 102; ii) the first and second fluid ports 23, 24 arranged on the valve housing 20; and, iii) inlet hydraulic fluid paths A, A1 of the HFCV 10.

Clockwise CW actuation of the rotor 102 relative the stator 104 requires pressurization of the first hydraulic actuation chambers 110A via the first hydraulic fluid gallery 112A and de-pressurization of the second hydraulic actuation chambers 110B via the second hydraulic fluid gallery 112B. Camshaft torques, sometimes referred to as "torsionals", act on the camshaft 150 in both clockwise and counterclockwise directions and are a result of valve train reaction forces that act on an opening flank and a closing flank of a camshaft lobe as it rotates. Assuming a clockwise rotating camshaft 150, an opening flank of a camshaft lobe can cause a counterclockwise CCW torque on the camshaft and camshaft phaser due to valve train reaction forces; furthermore, a closing flank of a camshaft lobe can cause a clockwise torque due to valve train reaction forces. In the case of a counterclockwise CCW torque, it is possible that this torque can overcome a force of a pressurized fluid F acting on a vane (or vanes) of the rotor 102 that is actuating the rotor 102 in a clockwise CW direction relative to the stator 104. In such an instance, hydraulic fluid F can be forced out of the first hydraulic actuation chambers 110A. The lobe of the camshaft 150 continues to rotate until it achieves its apex (peak lift) and then engagement of the closing flank of the lobe with the valve train causes a clockwise torque CW to act on the camshaft lobe. A counterclockwise torque CCW followed by a clockwise torque CW can induce a negative pressure in the first hydraulic actuation chambers 110A, requesting more oil to fill the first hydraulic actuation chambers 110A. This disclosure describes a recirculating HFCV in the following paragraphs, that can not only increase an HFCV's reactiveness to such torsionals and resultant negative pressures but can also reduce a camshaft phaser's pressurized hydraulic fluid consumption. This operating principle is achieved by routing some of the hydraulic fluid that is exiting one group of hydraulic actuation chambers to the other group of hydraulic actuation chambers for replenishment purposes.

The spool 40 includes, in successive longitudinal order: a spring end 41, a first land 42, a second land 43, a third land 44, a fourth land 45, a fifth land 46, and the push pin receiving land 47 at the actuator end 48. The first and second lands 42, 43 form a first segment of the spool 40 that defines a first outer annulus 49; the second and third lands 43, 44 form a second segment that defines a second outer annulus 50; the third and fourth lands 44, 45 form a third segment that defines a third outer annulus 51; the fourth and fifth lands 45, 46 form a fourth segment that defines a fourth outer annulus 52. The spool 40 further includes: first through-holes 53A arranged between the first and second lands 42, 43, within the first outer annulus 49; second through-holes 53B arranged between the second and third lands 43, 44, within the second outer annulus 50; third through-holes 53C arranged between the third and fourth lands 44, 45, within the third outer annulus 51. The spool 40 is closed at the actuator end 48 and open at the spring end 41.

The spool 40 has a longitudinal bore 54 having an inner radial surface 55, and, together with a piston 57 disposed within the spring end 41 of the spool 40, form an inner fluid chamber 58. The piston 57 and the inner radial surface 55 also define an annular cavity 59 which receives the bias spring 56. Other arrangements of the spool 40 that do not include the piston 57 are also possible. It could be stated that the inner fluid chamber 58 includes the first, second, and third through-holes 53A-53C, such that the first, second, and third through-holes 53A-53C are fluidly connected to the inner fluid chamber 58. Furthermore, the first, second, and third through-holes 53A-53C can all be continuously fluidly connected to each other via the inner fluid chamber 58. That is, regardless of a position of the spool, a continuous fluid connection between any one of the three through-holes 53A-53C and any or all of the remaining two through-holes can exist, as shown in the figures. For the discussion of this disclosure, two adjacent fluid galleries that are connected to each other via a one-way fluid valve are "fluidly connected" but not "continuously fluidly connected", as there are defined fluid pressure conditions that do not yield a flow of fluid from one hydraulic fluid gallery to the other. The spool 40 and its five lands 41-46, four outer annuli 49-52, push pin receiving land 47, and first, second, and third through-holes 53A-53C are integrally formed as one piece.

For the discussion of this disclosure, the inner fluid chamber 58 is defined by a cavity, hollow or void that directly contacts and houses a volume of hydraulic fluid, particularly hydraulic fluid that is routed to or from the hydraulic actuation chambers 108. The inner fluid chamber 58 can be continuous without interruption (or continuously open), such that its entire length L directly contacts hydraulic fluid; stated otherwise, the inner fluid chamber 58 can be continuous from the first through-hole 53A to the third through-hole 53C so that hydraulic fluid can continuously flow and be housed within the inner fluid chamber 58 from the first through-hole 53A to the third through-hole 53C without interruption. The inner fluid chamber 58 can be shaped as a bore, as shown in the figures, or any other suitable shape to receive and contact hydraulic fluid. As shown in the figures, additional components of the HFCV 10 are not installed or disposed within the inner fluid chamber 58, however, such an arrangement could be possible. As shown in FIG. 9B, a cross-sectional area of the inner fluid chamber 58 at any longitudinal position X within the length L of the inner fluid chamber 58 can be computed by multiplying a square of a radius Rx by pi (3.14159). The radius Rx extends from central axis 85, which could also be described as an actuation axis, of the HFCV 10 to the inner radial surface 55 of the bore 54 that defines the inner fluid chamber 58. The radius of the bore 54 shown in the figures is constant, however, the bore could have different radii throughout its length. Even so, the cross-sectional area of the inner fluid chamber 58 could still be defined by $((pi) \times Rx^2)$. In addition to being continuously open in a longitudinal direction from the first through-hole 53A to the third through-hole 53C, it could also be stated that the inner fluid chamber 58 is continuously open in a radial direction from the central axis 85 to the inner radial surface 55. A cutting plane that is arranged transversely to the central axis 85 and cuts through the inner fluid chamber 58 does not cut through any material (steel, plastic, etc.) from the inner radial surface 55 to the central axis 85. Therefore, the volume of the inner fluid chamber 58 can be determined by multiplying a cross-sectional area by its length L.

The spool 40 is disposed within a bore 61 or hollow of the hydraulic sleeve 60. The hydraulic sleeve 60 is disposed within the first bore 28 of the valve housing 20. The first, second, third, fourth, and fifth lands 42-46 of the spool 40 engage and are slidably guided in a sealing manner by an inner radial surface 62 of the bore 61 of the hydraulic sleeve 60. The hydraulic sleeve 60 has an open actuation end 63 and a closed retaining end 64. The closed retaining end 64 forms an axial abutment 65 for the bias spring 56 and includes exit ports 66 for hydraulic fluid to exit the HFCV 10. The exit ports 66 are fluidly connected to a second venting hydraulic fluid path T2, described later in this disclosure.

The hydraulic sleeve 60 can be fulfilled as a single part or as a two-part hydraulic sleeve constructed from either an insert molding process or an overmolding process. Other processes or designs are also possible that fulfill the function of the hydraulic sleeve 60 described herein. FIG. 7A shows the hydraulic sleeve 60 without the first and second one-way valves 87A, 87B installed and FIG. 7B shows the hydraulic sleeve 60 with the first and second one-way valves 87A, 87B installed. FIG. 8 shows a hydraulic sleeve 60A as a two-part construction that includes an inner sleeve 67 and an overmold 68. The inner sleeve 67 can be fabricated from metal or plastic and the overmold 68 can be fabricated from plastic, an elastomer, or any suitable material. A metal inner sleeve 67 can be manufactured from a drawing, extruding, or any suitable manufacturing process.

The hydraulic sleeve 60 has a first array of through-apertures 92A and a second array of through-apertures 93A. The first array of through-apertures 92A is aligned with and continuously fluidly connected to the first array of ports 90A on the valve housing 20. The second array of through-apertures 93A is aligned with and continuously fluidly connected to the second array of ports 91A on the valve housing 20. The first array of through-apertures 92A includes a supply through-aperture 70, a first through-aperture 71, and a second through-aperture 72.

The second array of through-apertures 93A includes a vent through-aperture 73', a supply through-aperture 70', a first through-aperture 71', a first pair of recirculation through-apertures 74', a second pair of recirculation through-apertures 75', and a second through-aperture 72'. A first one-way valve 87A covers the first pair of recirculation through-apertures 74', and a second one-way valve 87B covers the second pair of recirculation through-apertures 75'. The first and second one-way valves 87A, 87B deflect radially outward to: i) allow a radially outward flow of hydraulic fluid from the respective first and second pairs of recirculation through-apertures 74',75' to the corresponding first and second fluid ports 23',24' of the valve housing 20, and ii) prevent a radially inward flow of hydraulic fluid from the first and second fluid ports 23',24' to the corresponding first and second pairs of recirculation through-apertures 74',75'. Each of these flow instances will be described in further detail later within this disclosure.

Within the second array of through-apertures 93A, the first through-aperture 71' and the first pair of recirculation through-apertures 74' both open into a first fluid opening 76' arranged radially outwardly of the first through-aperture 71' and the first pair of recirculation through-apertures 74'. The first fluid opening 76' overlaps with the first fluid port 23', and since the hydraulic sleeve 60 is fixed to one relative position relative to the valve housing 20, the first fluid opening 76' is continuously fluidly connected to the first fluid port 23' of the valve housing 20. Also within the second array of through-apertures 93A, the second through-aperture 72' and the second pair of recirculation through-apertures 75' both open into a second fluid opening 77' arranged radially outwardly of the second through-aperture 72' and the second pair of recirculation through-apertures 75'. The second fluid opening 77' overlaps with the second fluid port 24' of the valve housing 20, and, thus is continuously fluidly connected to the second fluid port 24'. A cross-bar 78 separates the first and second fluid openings 76',77' and sealingly engages an inner radial surface 33 of the first bore 28 of the valve housing 20 so that the first fluid opening 76' is axially sealed from the second fluid opening 77'. Further reference to the second array of through-apertures 92A equates to the following features: the vent through-aperture 73', the supply through-aperture 70', the first through-aperture 71', the second through-aperture 72' and the first and second fluid openings 76',77'.

The first array of through-apertures 92A has a duplicate first array of through-apertures 92B arranged in an opposed or 180 degree circumferential angular increment relative to the first array of through-apertures 92A. Likewise, the second array of through-apertures 93A has a duplicate second array of through-apertures 93B arranged in an opposed or 180 degree circumferential angular increment relative to the second array of through-apertures 93A. With reference to the Figures, the element numbers of the duplicate first and second arrays of through-apertures 92B, 93B are identical to the element numbers of the first and second arrays of through-apertures 92A, 93A. FIGS. 7A and 7B show a parametric views of the first and second arrays of through-apertures 92A, 93A, while the bottom of cross-sectional views of FIGS. 9A-9C show the duplicate first array of through-apertures 92B, and the bottom of cross-sectional views of FIGS. 10A-10C show the duplicate second array of through-apertures 93B. For further clarity, FIGS. 9A and 11A identify the matched sets of arrays of both the hydraulic sleeve 60 and valve housing 20 at the respective top and bottom of each of these cross-sectional views. The matched arrays identified in FIG. 9A also apply to FIGS. 9B and 9C and the matched arrays identified in FIG. 11A also apply to FIGS. 11B and 11C.

FIGS. 9A, 10A, and 11A all show different cross-sectional views of the HFCV 10 when the HFCV 10 is in a de-energized state and the spool 40 is in an extended position. The following discussion describes various hydraulic fluid paths and the respective fluid connections that are present with the spool 40 in this extended position. Each of the described hydraulic fluid paths are arranged in opposed pairs within the HFCV 10.

FIG. 9A is a cross-sectional view of the HFCV 10 that shows an inlet hydraulic fluid path A and a return hydraulic fluid path B of the HFCV 10 when the HFCV 10 is in a de-energized state and the spool 40 is in the extended position. In this extended position of the spool 40, the bias spring 56 applies a force Fb to the spring end 41 of the spool 40, such that the actuator end 48 of the spool 40 engages a base 27 of the second pole 26 of the valve housing 20. Tracing the path of inlet hydraulic fluid path A, hydraulic fluid flows from the hydraulic fluid pressure source 35, through the supply fluid ports 22 of the housing, through the supply through-apertures 70 of the hydraulic sleeve 60, through the fourth outer annulus 52 and third through-holes 53C of the spool 40, and to the inner fluid chamber 58 of the spool 40; once the hydraulic fluid reaches the inner fluid chamber 58, it flows continuously without interruption in a first flow direction FD1 toward the spring end 41 of the spool until reaching a longitudinal position of the first through-holes 53A; from the inner fluid chamber 58, the hydraulic fluid flows through the first through-holes 53A and first outer annulus 49 of the spool 40, through the second through-apertures 72 of the hydraulic sleeve 60, through the second fluid ports 24 of the valve housing 20, and to the second hydraulic actuation chambers 110B.

Tracing the path of return hydraulic fluid path B of FIG. 9A, hydraulic fluid flows from the first hydraulic actuation chambers 110A, through the first fluid ports 23 of the valve housing 20, through the first through-apertures 71 of the hydraulic sleeve 60, and to the second outer annulus 50 of the spool 40. Hydraulic fluid flow from the second outer annulus 50 is then directed to either a second venting hydraulic fluid path T2 or a recirculating hydraulic fluid path R', as will now be described with reference to FIG. 10A.

FIG. 10A also shows a cross-sectional view of the HFCV 10 in the de-energized state and the spool in the extended position, but, as shown in FIG. 1, in a different cutting plane than the cross-sectional view of FIG. 9A. FIG. 10A shows an inlet hydraulic fluid path A', the return hydraulic fluid path B', a first venting hydraulic fluid path T1, a first portion of the second venting hydraulic fluid path T2, and a recirculating hydraulic fluid pathway R'. Tracing the path of hydraulic fluid path A', hydraulic fluid flows from the hydraulic fluid pressure source 35, through the supply fluid ports 22' of the valve housing 20, through the supply through-apertures 70' of the hydraulic sleeve 60, through the fourth outer annulus 52 and third through-holes 53C of the spool 40, and to the inner fluid chamber 58 of the spool 40; once inside of the inner fluid chamber 58, the hydraulic flows continuously without interruption in the first flow direction FD1 toward the spring end 41 of the spool 40 until reaching a longitudinal position of the first through-holes 53A; from the inner fluid chamber 58, the hydraulic fluid flows through the first through-holes 53A and first outer annulus 49 of the spool 40, through the second through-apertures 72' of the hydraulic sleeve 60, through the second fluid ports 24' of the valve housing 20, and to the second hydraulic actuation chambers 110B.

Tracing the path of the first venting hydraulic fluid path T1 of FIG. 10A, hydraulic fluid flows from the vent through-aperture 73' to the vent fluid port 21'. Hydraulic fluid that exits the vent fluid port 21' will return to a hydraulic fluid sump, typically for that of the hydraulic fluid pressure source 35. One purpose of the first venting hydraulic fluid path T1 is to vent hydraulic fluid that collects within the vent through-aperture 73' due to internal radial leakage that occurs between either: i) the fifth land 46 of the spool 40 and the inner radial surface 62 of the bore 61 of the hydraulic sleeve 60; or ii) a radial outer surface 69 of the hydraulic sleeve 60 and an inner radial surface 33 of the first bore 28 of the valve housing 20. A second purpose of the first venting hydraulic fluid path T1 is to vent hydraulic fluid that collects within a cavity 36 formed between the actuator end 48 of the spool 40 and the second pole 26 of the valve housing 20.

Tracing the path of return hydraulic fluid path B' of FIG. 10A, hydraulic fluid flows from the first hydraulic actuation chambers 110A, through the first fluid ports 23' of the valve housing 20, through the first fluid opening 76' and the first through-aperture 71' of the hydraulic sleeve 60, and to the second outer annulus 50 of the spool 40. From the second outer annulus 50, the hydraulic fluid can be split into two separate hydraulic fluid paths, a second venting hydraulic fluid path T2 and a recirculation hydraulic fluid path R'. The recirculation hydraulic fluid path R' facilitates efficient recycling of hydraulic fluid from the first hydraulic actuation chambers 110A to the second hydraulic actuation chambers 110B. The recirculation hydraulic fluid path R' moves in the first fluid direction FD1 within the second outer annulus 50, through the second recirculation through-apertures 75', the second one-way valves 87B, and the second fluid opening 77' of the hydraulic sleeve 60, and through the second fluid ports 24' of the valve housing 20. The amount of hydraulic fluid that is delivered to the second hydraulic actuation chambers 110B from the first hydraulic actuation chambers 110A via the recirculation hydraulic fluid path R' is dependent on need, or a pressure differential condition between the second outer annulus 50 of the spool 40 and the second hydraulic actuation chambers 110B. In order for positive hydraulic fluid flow to occur from the second outer annulus 50 to the second hydraulic actuation chambers 110B, a hydraulic fluid pressure P3 within the second outer annulus 50 needs to be greater than a hydraulic fluid pressure P2 within the second actuation chambers 110B. Such a pressure differential condition defines a positive pressure differential. Furthermore, an amount of hydraulic fluid delivered from the second outer annulus 50 (via the first hydraulic actuation chambers 110A) to the second hydraulic actuation chambers 110B in a first positive pressure differential condition ΔP1 is different than an amount of hydraulic fluid delivered from the second outer annulus 50 to the second hydraulic actuation chambers 110B in a second positive pressure differential condition ΔP2 that is different than the first positive pressure differential condition ΔP1. Correspondingly, an amount of hydraulic fluid delivered to the second venting hydraulic fluid path T2 from the second outer annulus 50 also depends on the previously described positive pressure differential between the second outer annulus 50 and the second hydraulic actuation chambers 110B, and therefore varies accordingly. This relationship is shown in mathematical equation form below.

X=amount of hydraulic fluid exiting first hydraulic actuation chambers 110A and delivered to second outer annulus 50 (path B')

Y=first fractional amount of X that is recirculated from first hydraulic actuation chambers 110A to the second hydraulic actuation chambers 110B (path R')

Z=second fractional amount of X that is exiting the HFCV 10 (path T2)

ΔP=hydraulic fluid pressure of second outer annulus 50—pressure of second hydraulic actuation chambers 110B $$X=Y+Z$$

For $\Delta P1=0.5$ bar:

$$X=Y1+Z1$$

For $\Delta P2=1$ bar:

$$X=Y2+Z2$$

Where: $Y2>Y1$ and $Z2<Z1$

The above positive pressure differential examples between the second outer annulus 50 and second hydraulic actuation chambers 110B illustrate how an amount of hydraulic fluid within the return hydraulic fluid path B' is divided amongst the recirculation hydraulic fluid path R' and the second venting hydraulic fluid path T2. In such positive pressure differential examples, an amount of fluid flow of the return hydraulic fluid path B' can be divided into two fluid flow amounts, a first fractional fluid flow amount Y within the recirculation hydraulic fluid path R' and a second fractional fluid flow amount Z within the second venting hydraulic fluid path T2. The first fractional fluid flow amount Y can vary from zero to X, an amount equal to that of the return hydraulic fluid path B'. The second fractional fluid flow amount Z can also vary from zero to X, an amount equal to that of the return hydraulic fluid path B'. Referencing the two ΔP examples above, for an increasing positive ΔP across the second outer annulus 50 and the second hydraulic actuation chambers 110A, 110B, the first fractional amount Y increases and the second fractional amount Z decreases. Furthermore, for a decreasing positive ΔP, the first fractional amount Y decreases and the second fractional amount Z increases. It could be stated that an amount of recirculated hydraulic fluid delivered to the second hydraulic actuation chambers 110B via recirculation hydraulic fluid path R' varies according to need.

FIG. 11A shows a cross-sectional view of the HFCV 10 that cuts through the second venting hydraulic fluid path T2 that extends from the second outer annulus 50 of the spool 40 to the retaining end 31 of the first bore 28 (or an open end) of the valve housing 20. The second venting hydraulic fluid path T2 includes two symmetrically opposed paths, as shown in FIG. 11A. Tracing the path of the second venting hydraulic fluid path T2, hydraulic fluid flows from the second outer annulus 50, through a first vent through-aperture 80 of the hydraulic sleeve 60, within an axially extending groove 79 of the hydraulic sleeve 60 in the first flow direction FD1, through a second vent through-aperture 81 of the hydraulic sleeve 60, through a spring well 82 formed between the axial abutment 65 of the hydraulic sleeve 60 and the spring end 41 of the spool 40, through exit ports 66 arranged on the axial abutment 65, through a retaining ring well 83 formed between the retaining ring 84 and axial abutment 65, and through an inner open area 86 of the retaining ring 84. Vented or exiting fluid from the HFCV 10 is then routed to a sump of the pressurized hydraulic fluid pressure source 35 such as an oil pump.

FIGS. 9B, 10B, and 11B show different cross-sectional views of the HFCV 10 when the HFCV 10 is in the first energized state and the spool 40 is in the middle position. The middle position of the spool 40 is achieved when the pulse-width modulated solenoid assembly 12 applies a first force F1-A on the actuator end 48 of the spool 40 to overcome the biasing force Fb of the bias spring 56. As shown in FIGS. 9B and 10B, neither the first outer annulus 49 or the third outer annulus 51 overlap with either of the first through-apertures 71, 71' or the second through-apertures 72, 72' of the hydraulic sleeve 60, blocking communication of: i) pressurized hydraulic fluid to either of the first or second hydraulic actuation chambers 110A, 110B, and ii) exiting hydraulic fluid from either of the first or second hydraulic actuation chambers 110A, 110B. Thus, the middle position of the spool 40 can be used to maintain a phasing position of the camshaft phaser 100, or stated otherwise, maintain a constant rotational position of the rotor 102 relative to the stator 104. With the spool 40 in the middle position, the first venting hydraulic fluid path T1, as previously described for FIG. 10A, is active and vents or exits hydraulic fluid to the sump of the hydraulic fluid pressure source 35. The second venting hydraulic fluid path T2, as previously described for FIGS. 10A and 11A, is also active; however in this instance, it exits hydraulic fluid that results from internal leakage of the HFCV 10 that flows to the second outer annulus 50 of the spool 40, and not from hydraulic fluid that is directed from one of the first or second hydraulic actuation chambers 110A, 110B, as described for FIG. 10A.

The described middle position of the spool 40 and corresponding flows (or lack of flows) represents one of many design scenarios. In other example embodiments, a small amount of flow to or from the first and second hydraulic actuation chambers 110A, 110B could be possible.

FIGS. 9C, 10C, and 11C show different cross-sectional views of the HFCV 10 when the HFCV 10 is in the second energized state and the spool 40 is selectively moved to the fully displaced position. The following discussion describes various hydraulic fluid paths and the respective fluid connections that are present with the spool 40 in this fully displaced position.

FIGS. 9C's cross-sectional view shows an inlet hydraulic fluid path A1 and a return hydraulic fluid path B1 of the HFCV 10. Each of these described hydraulic fluid paths A1, B1 are arranged in opposed pairs within the HFCV 10. In this fully displaced position of the spool 40, the pulse-width modulated solenoid assembly 12 applies a second force F1-B, on the actuator end 48 of the spool 40 to overcome the biasing force Fb of the bias spring 56. The second force F1-B is greater in magnitude than the previously described first force F1-A. Tracing the path of inlet hydraulic fluid path A1, hydraulic fluid flows from the hydraulic fluid pressure source 35, through the supply fluid ports 22 of the valve housing 20, through the supply through-apertures 70 of the hydraulic sleeve 60, through the fourth outer annulus 52 and third through-holes 53C of the spool 40, and to the inner fluid chamber 58 of the spool 40; once the hydraulic fluid reaches the inner fluid chamber 58, it flows continuously without interruption in the first flow direction FD1 toward the spring end 41 of the spool until reaching a longitudinal position of the second through-holes 53B; from the inner fluid chamber 58, the hydraulic fluid flows through the second through-holes 53B and third outer annulus 51 of the spool 40, through the first through-apertures 71 of the hydraulic sleeve 60, and through the first fluid ports 23 of the valve housing 20, and to the first hydraulic actuation chambers 110A.

Tracing the path of return hydraulic fluid path B1 of FIG. 9C, hydraulic fluid flows from the second hydraulic actuation chambers 110B, through the second fluid ports 24 of the valve housing 20, through the second through-apertures 72 of the hydraulic sleeve 60, and to the second outer annulus 50 of the spool 40. Hydraulic fluid flow from the second outer annulus 50 can either be directed to the second venting hydraulic fluid path T2 or a recirculating hydraulic fluid path R1', which will now be described with reference to FIG. 10C.

FIG. 10C shows an inlet hydraulic fluid path A1', a return hydraulic fluid path B1', the first venting hydraulic fluid path T1, a first portion of the second venting hydraulic fluid path T2, and a recirculating hydraulic fluid pathway R1'. Each of these hydraulic fluid paths A1', B1', T1, T2 are arranged in opposed pairs within the HFCV 10.

Tracing the path of inlet hydraulic path A1', hydraulic fluid flows from the hydraulic fluid pressure source 35, through the supply fluid ports 22' of the valve housing 20, through the supply through-apertures 70' of the hydraulic sleeve 60, through the fourth outer annulus 52 and third through-holes 53C of the spool 40, and to the inner fluid chamber 58 of the spool 40; once inside of the inner fluid chamber 58, the hydraulic fluid flows continuously without interruption in the first flow direction FD1 toward the spring end 41 of the spool 40 until reaching a longitudinal position of the second through-holes 53B; from the inner fluid chamber 58, the hydraulic fluid flows through the second through-holes 53B and third outer annulus 51 of the spool 40, through the first through-aperture 71' and first fluid opening 76' of the hydraulic sleeve 60, and through the first fluid port 23' of the valve housing 20 before reaching the first hydraulic actuation chambers 110A.

The phrase "flows continuously without interruption" is meant to describe flow within the continuously hollow inner fluid chamber 58, which is void of internal components that hydraulic fluid would have to flow around, inside of, or through in order to reach the longitudinal position of the second through-holes 53B.

The path of the first venting hydraulic fluid path T1 of FIG. 10C is the same as that which was described earlier for FIGS. 10A and 10B, therefore, further discussion is not necessary.

Tracing the path of return hydraulic fluid path B1' of FIG. 10C, hydraulic fluid flows from the second hydraulic actuation chambers 110B, through the second fluid ports 24' of the valve housing 20, through the second fluid opening 77' and the second through-aperture 72' of the hydraulic sleeve 60, and to the second outer annulus 50 of the spool 40. From the second outer annulus 50, the hydraulic fluid can be split into two separate hydraulic fluid paths, the second venting hydraulic fluid path T2 and a recirculation hydraulic fluid path R1'. The recirculation hydraulic fluid path R1' facilitates efficient recycling of hydraulic fluid from the second hydraulic actuation chambers 110B to the first hydraulic actuation chambers 110A. The recirculation hydraulic fluid path R1' moves in a second fluid direction FD2 within the second outer annulus 50, through the first recirculation through-apertures 74', the first one-way valves 87A, and the first fluid opening 76' of the hydraulic sleeve 60, and through the first fluid ports 23' of the valve housing 20. The amount of hydraulic fluid that is delivered to the first hydraulic actuation chambers 110A from the second hydraulic actuation chambers 110B via the recirculation hydraulic fluid path R1' is dependent on need, or, on a pressure differential between the second outer annulus 50 of the spool and the first hydraulic actuation chambers 110A. This is similar to that which was described earlier for FIG. 10A, however, in an example embodiment, for flow to occur within the recirculation hydraulic fluid path R1' from the second outer annulus 50 to the first hydraulic actuation chambers 110A, a hydraulic fluid pressure P3 of the second outer annulus 50 is greater than a hydraulic fluid pressure P1 of the first hydraulic actuation chambers 110A. Furthermore, an amount of hydraulic fluid delivered from the second outer annulus 50 (via the second hydraulic actuation chambers 110B) to the first hydraulic actuation chambers 110A in a first positive pressure differential condition ΔP1' is different than an amount of hydraulic fluid delivered from the second outer annulus 50 to the first hydraulic actuation chambers 110A in a second positive pressure differential condition ΔP2' that is different than the first positive pressure differential condition ΔP1'. Correspondingly, an amount of hydraulic fluid delivered to the second venting hydraulic fluid path T2 from the second outer annulus 50 also depends on the positive pressure differential between the second outer annulus 50 and the first hydraulic actuation chambers 110A, and therefore varies accordingly. The previous mathematical equations and discussion provided for the recirculation and venting hydraulic fluid amounts of FIG. 10A also apply to FIG. 10C's recirculation and venting hydraulic amounts, so further discussion is not necessary.

FIG. 11C shows a cross-sectional view of the HFCV 10 that cuts through the second venting hydraulic fluid paths T2 that extend from the second outer annulus 50 of the spool 40 to the retaining end 31 of the first bore 28 of the valve housing 20. The second venting hydraulic fluid paths T2 of FIG. 11C are identical in flow path and function to the second venting hydraulic fluid paths T2 described earlier for FIG. 11A, so further discussion is not necessary.

The sizes and/or diameter of the through-apertures and openings of the second venting hydraulic fluid path T2 can be adjusted to tune the amount of recirculation that occurs within the HFCV 10. This amount could be dependent upon the magnitude of the camshaft torsionals acting on the camshaft phaser; for example, higher camshaft torsionals may require a smaller sized vent through-aperture.

The flow paths shown in the Figures are symmetrically arranged in pairs relative to a circumference of the cylinder sleeve. In the example embodiment shown in the figures, a transverse cutting plane that intersects the central axis 85 of the HFCV 10 and one of the flow paths also intersects a second instance of the same flow path. Other arrangements of flow paths are also possible, including non-symmetrical arrangements.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A hydraulic fluid control valve, comprising:

a valve housing including:

a first fluid port configured to be fluidly connected to a first hydraulic actuation chamber; and, a second fluid port configured to be fluidly connected to a second hydraulic actuation chamber, the first and second hydraulic actuation chambers configured to receive and exhaust hydraulic fluid;

a spool disposed within a bore of the valve housing, the spool including a first aperture;

a second aperture;

a third aperture;

an outer annulus; and, an inner fluid chamber configured to flow hydraulic fluid from: i) the first aperture to the second aperture, and ii) the first aperture to the third aperture, wherein in a longitudinal direction of the spool:

the second aperture is arranged between the first and third apertures;

the outer annulus is arranged between the second and third apertures; and, the inner fluid chamber extends from the first aperture to the third aperture; and, in a first axial position of the spool:

the first aperture is configured to deliver hydraulic fluid to the first hydraulic actuation chamber; and, the outer annulus is configured to receive hydraulic fluid from the second hydraulic actuation chamber and deliver at least a portion of the hydraulic fluid from the second hydraulic actuation chamber to the first hydraulic actuation chamber without passing through the inner fluid chamber; and, in a second axial position of the spool:

the third aperture is configured to deliver hydraulic fluid to the second hydraulic actuation chamber; and, the outer annulus is configured to receive hydraulic fluid from the first hydraulic actuation chamber and deliver at least a portion of the hydraulic fluid from the first hydraulic actuation chamber to the second hydraulic actuation chamber without passing though the inner fluid chamber.

2. The hydraulic fluid control valve of claim 1, wherein the first aperture is arranged at an actuation end of the spool, and the third aperture is arranged at a spring end of the spool.

3. The hydraulic fluid control valve of claim 2, wherein the inner fluid chamber is configured to continuously fluidly connect the first, second, and third apertures to each other in the first and second axial positions of the spool.

4. The hydraulic fluid control valve of claim 1, wherein:

in the first axial position of the spool, the outer annulus is configured to: i) deliver a portion of the hydraulic fluid from the second hydraulic actuation chamber to the first hydraulic actuation chamber, and ii) deliver a remaining portion of the hydraulic fluid from the second hydraulic actuation chamber to a vent arranged within the hydraulic fluid control valve; and, in the second axial position of the spool, the outer annulus is configured to: i) deliver a portion of the hydraulic fluid from the first hydraulic actuation chamber to the second hydraulic actuation chamber, and ii) deliver a remaining portion of the hydraulic fluid from the first hydraulic actuation chamber to the vnet.

5. The hydraulic fluid control valve of claim 4, wherein the vent is fluidly connected to an axial end of the hydraulic fluid control valve.

6. The hydraulic fluid control valve of claim 4, wherein the first aperture is configured to receive hydraulic fluid from a pressurized hydraulic fluid source.

7. The hydraulic fluid control valve of claim 6, further comprising a one-way valve arranged between the spool and an inner surface of the bore, the one-way valve configured to: i) allow hydraulic fluid to flow from the outer annulus to the first and second hydraulic actuation chambers, and ii) prevent hydraulic fluid to flow from the first and second hydraulic actuation chambers to the outer annulus.

8. The hydraulic fluid control valve of claim 7, wherein the one-way valve opens in a radially outward direction so as to allow the hydraulic fluid to flow from the outer annulus to the first and second hydraulic actuation chambers.

9. The hydraulic fluid control valve of claim 8, further comprising a hydraulic sleeve arranged radially between the spool and the valve housing, wherein the one-way valve is arranged on the hydraulic sleeve.

10. The hydraulic fluid control valve of claim 8, wherein the valve housing further includes a third fluid port configured to fluidly connect the spool to the pressurized hydraulic fluid source.

11. The hydraulic fluid control valve of claim 10, wherein the valve housing further includes a fourth fluid port configured as a vent port, the fourth fluid port arranged between the third fluid port and a solenoid of the hydraulic fluid control valve in a longitudinal direction of the hydraulic fluid control valve.

12. A hydraulic fluid control valve, comprising:

a valve housing including:

a first fluid port configured to be fluidly connected to a first hydraulic actuation chamber; and, a second fluid port configured to be fluidly connected to a second hydraulic actuation chamber, the first and second hydraulic actuation chambers configured to receive and exhaust hydraulic fluid;

a spool disposed within a bore of the valve housing, the spool including:

a first aperture;

a second aperture;

a third aperture;

an outer annulus; and, an inner fluid chamber configured to flow hydraulic fluid from: i) the first aperture to the second aperture, and ii) the first aperture to the third aperture; and, wherein:

in a longitudinal direction of the spool:

the second aperture is arranged between the first and third apertures;

the outer annulus is arranged between the second and third apertures;

and, the inner fluid chamber extends from the first aperture to the third aperture; and, in a first pressure state of the first hydraulic actuation chamber:

the outer annulus is configured to: i) receive a first amount of hydraulic fluid from the second hydraulic actuation chamber, and ii) deliver a first fraction of the first amount to the first hydraulic actuation chamber without passing through the inner fluid chamber; and, in a second pressure state of the first hydraulic actuation chamber different than the first pressure state:

the outer annulus is configured to: i) receive the first amount of hydraulic fluid from the second hydraulic actuation chamber, and ii) deliver a second fraction of the first amount to the first hydraulic actuation chamber without passing through the inner fluid chamber, the second fraction being greater than the first fraction.

13. The hydraulic fluid control valve of claim 12, wherein:

in the first pressure state, the outer annulus delivers a third fraction of the first amount to a vent of the hydraulic fluid control valve; and, in the second pressure state, the outer annulus delivers a fourth fraction of the first amount to the vent, the fourth fraction being less than the third fraction.

14. The hydraulic fluid control valve of claim 13, wherein the vent connects to an axial end of the hydraulic fluid control valve.

15. A hydraulic fluid control valve for attachment as a single unit to an internal combustion engine, the hydraulic fluid control valve comprising:

a coil;

an armature surrounded by the coil and configured to be actuated by a magnetic field generated by the coil;

a push pin attached to the armature;

a valve housing including:

a first radial fluid port configured to be fluidly connected to a first hydraulic actuation chamber;

a second radial fluid port configured to be fluidly connected to a second hydraulic actuation chamber; and, a third radial fluid port configured to be fluidly connected to a pressurized hydraulic fluid source; and, a spool disposed within a bore of the valve housing so as to be actuated by the push pin, the spool including:

a first outer land;

a second outer land;

an outer annulus formed by the first and second outer lands, the outer annulus configured to: i) recirculate a portion of hydraulic fluid from one of the first or second hydraulic actuation chambers to a remaining one of the first or second hydraulic actuation chambers, and, ii) route a remaining portion of the hydraulic fluid to a vent passage of the hydraulic fluid control valve; and, an inner fluid chamber comprising a radial outer wall including:

a first aperture;

a second aperture; and a third aperture; and wherein:

the inner fluid chamber is configured to continuously fluidly connect the first, second, and third apertures to each other, the first and second outer lands, the radial outer wall, and the first, second, and third apertures, are all formed integrally with the spool, and, the portion of the hydraulic fluid is recirculated without passing through the inner fluid chamber.

16. The hydraulic fluid control valve of claim 15, wherein the vent passage extends axially toward a spring end of the spool and exits through an axial open end of the hydraulic fluid control valve.

17. The hydraulic fluid control valve of claim 15, further comprising a one-way valve arranged between the spool and an inner radial surface of the bore.

18. The hydraulic fluid control valve of claim 17, further comprising a stationary hydraulic sleeve arranged radially between the spool and the valve housing, wherein the one-way valve is arranged on the stationary hydraulic sleeve.

19. The hydraulic fluid control valve of claim 18, wherein the stationary hydraulic sleeve includes:

at least one first fluid opening continuously fluidly connected to the first aperture;

at least one second fluid opening configured to be selectively fluidly connected to one of either the second aperture or the outer annulus;

at least one third fluid opening configured to be selectively fluidly connected to one of the third aperture or the outer annulus; and, at least one fourth fluid opening configured to be continuously fluidly connected to the outer annulus.

20. The hydraulic fluid control valve of claim 19, wherein the at least one fourth fluid opening is further configured to be fluidly connected to the first and second hydraulic actuation chambers.

* * * * *